United States Patent [19]

Davis

[11] Patent Number: 4,712,733

[45] Date of Patent: Dec. 15, 1987

[54] INTERNALLY MOUNTED DUTY CYCLING CONTROL

[76] Inventor: Raymond K. Davis, 40 Edgewood Dr., Lawrenceburg, Ind. 47025

[21] Appl. No.: 842,829

[22] Filed: Mar. 24, 1986

[51] Int. Cl.[4] ..... F23N 5/20

[52] U.S. Cl. ..... 236/10; 62/231; 236/46 R; 236/DIG. 12

[58] Field of Search ..... 236/10, 11, 46 R, 93 R, 236/16, DIG. 12, 46 E; 165/12; 62/231; 337/380

[56] References Cited

U.S. PATENT DOCUMENTS

| | | | |
|---|---|---|---|
| 1,918,778 | 7/1933 | Persons | 236/10 |
| 1,956,608 | 5/1934 | Bailey | 236/46 E |
| 3,546,652 | 12/1970 | Allen et al. | 337/38 C |
| 3,776,214 | 12/1973 | Coffman | 236/11 X |
| 3,921,899 | 11/1975 | Hamilton . | |
| 4,136,730 | 1/1979 | Kinsey . | |
| 4,240,579 | 12/1980 | Post . | |
| 4,470,267 | 9/1984 | Davis et al. | 62/229 |
| 4,534,181 | 8/1985 | Brown . | |

*Primary Examiner*—William E. Wayner
*Attorney, Agent, or Firm*—Wood, Herron & Evans

[57] ABSTRACT

A heating system and air conditioning system incorporating a duty cycling control switch are disclosed. The duty cycling control switch for either the furnace or air conditioning system is mounted within the supply side duct of the system, i.e., the hot air duct for a furnace or cold air duct for an air conditioner. The duty cycling control is a bi-metal switch totally enclosed within a case having a metal base whereby the heat from the air in the duct contacts the metal base which is transferred to a bi-metallic element which in turn opens or closes a switch. This makes the switch particularly responsive to gradual changes in the temperature of the output air but prevents the duty cycling switch from responding to rapid fluctuations of air temperature within the duct.

13 Claims, 4 Drawing Figures

INTERNALLY MOUNTED DUTY CYCLING CONTROL

BACKGROUND OF THE INVENTION

Heating systems and air conditioning systems are generally operable in response to a thermostat. The thermostat opens or closes in response to the surrounding temperature and acts to maintain the heating and air conditioning system in operation until a pre-set temperature is reached. Both heating and air-conditioning systems operate efficiently only for a short period.

In a furnace the temperature of the heat exchanger increases as fuel burns. Eventually the heat exchanger surface in contact with the fire box becomes so hot that the heated air is forced from the fire box through the chimney without raising the temperature of the heat exchanger and thus energy is wasted.

For this reason, it is preferable that the heating source of a furnace periodically shut down while air is forced through the heat exchanger causing the surface to cool down. This permits heat from the fire box to efficiently transfer heat to the heat exchanger.

With an air-conditioning system, the compressor operates and causes coils within the plenum to cool to a minimum of about 34° C. Even though the coils are at their minimum temperature, the compressor continues to operate using energy but without value.

A solution to this problem has been to incorporate a duty cycling switch with the furnace or air conditioner. Various types of these are known, for example, Kinsey U.S. Pat. No. 3,136,730 discloses a method to improve furnace efficiency by running the burner for only a pre-set period of time and then restarting the burner after a second pre-set period of time. This may be effective for new units which can be designed for a particular house and a particular plenum. But establishing what the pre-set periods of time for an existing unit is very difficult. Changes in demand for heating or cooling make these preset periods of time very inaccurate.

Hamilton U.S. Pat. No. 3,921,899 discloses a temperature sensing duty cycling switch which attaches to the plenum and controls the flow of gas to the burner of a furnace in response to the temperature inside the plenum. When the temperature is below a certain temperature, the burner can be activated. If the plenum temperature exceeds a certain temperature the burner is deactivated. Although the system disclosed in the Hamilton reference measures temperature, because the switch utilizes a temperature probe inserted into the plenum, it is excessively responsive to rapid temperature fluctuations within the plenum. Further, there are substantial differences in the temperature of the air within the plenum at various locations. The system disclosed in Hamilton is totally ineffective for retro-fitting existing units. Brown U.S. Pat. No. 4,534,181 discloses the use of a duty cycling switch with an air conditioner.

A duty cycling switch disclosed in Davis et al U.S. Pat. No. 4,470,267 is specially designed to retro-fit existing units. It is designed to mount to the exterior wall of a furnace or air conditioning plenum and opens and closes in response to the temperature of the plenum wall. The switch can be adjusted to be deactivated at a desired temperature preferably the temperature at which the furnace or air conditioner is operating most efficiently. More particularly this switch is a bi-metal duty cycling switch which is enclosed within a case wherein the base of the case is metal. The bi-metal switch is in direct contact with the metal base plate which in turn contacts the plenum wall. This switch has been found to be effective to efficiently duty cycle air conditioners and furnaces.

The unit disclosed in the Davis Patent is unfortunately ineffective where excessive temperatures are experienced on the exterior of the plenum wall. This can occur in various situations and is particularly encountered with roof mounted heating or air conditioning units. In many homes and buildings, the heating or air conditioning units are mounted directly to the roof of the building. The ducts go directly through the roof into the home. There is no accessable portion inside the attic to mount a duty cycling switch. Mounting it to the exterior of the duct exposed on the roof makes the switch responsive to exterior ambient temperature as opposed to the temperature of the furance or air conditioner plenum.

If a bi-metal switch is simply located inside the duct it suffers from the sam disadvantages of the duty cycling switch disclosed in the Hamilton reference. Due to the rapid fluctuation of air temperature as well as the variation of air temperature within the duct the switch would be given to false readings and therefore it would be ineffective.

As previously stated due to excessive external temperatures, it cannot be mounted to the exterior of the duct exposed to ambient temperatures.

SUMMARY OF THE INVENTION

The present invention is premised on the realization that an effective duty cycling control system can be established wherein a temperature sensitive duty cycling switch is mounted interiorly of the supply side duct of a furnace or air conditioner where the entire switch is encased to prevent air flowing through the duct directly contacting the temperature sensitive element. The temperature sensitive switch is thermally connected to a metallic base plate of the case to make the switch responsive to the temperature of the base plate. The base plate is in turn connected to a heavy gauge metallic bracket holding the temperature sensitive switch within the duct thereby making the temprature sensitive element responsive to the temperature of the metal bracket. Preferably insulation is maintained between the switch and the exterior wall of the duct to minimize the effect of exterior ambient temperature on the duty cycling control switch. Finally, an opening is provided in the case to permit adjusting the duty cycling control switch. The objects and advantages of the present invention will be further appreciated in light of the detailed description and drawings in which:

DETAILED DESCRIPTION

Figure 1:
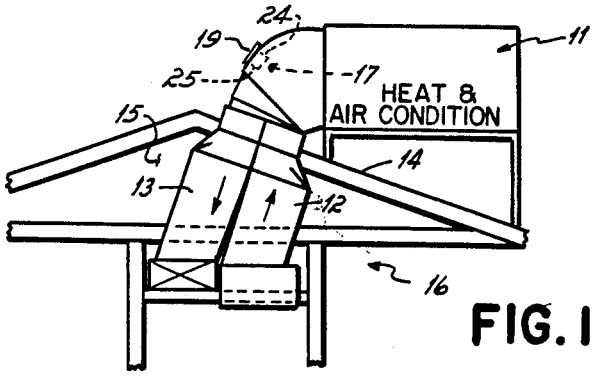
FIG. 1 is a side plan view partially in cross section of the heating or air conditioning system incorporating the present invention.

The present invention is initially described for use with a furnace. As shown in the drawing, the furnace may be a combination furnace and air conditioning unit. For use with an air conditioner, the duty cycling control is mounted and installed in the same manner described below for a furnace. The primary difference is that the furnace duty cycle control opens on rising temprature and the air conditioner control closes on rising temperature. Otherwise the switch and mounting bracket are identical.

As shown in FIG. 1 there is a roof mounted gas or oil furnace 11 which includes a return air duct 12, and a supply side duct or hot air duct 13. The supply side duct 13 as well as the cold air return 12, pass from the furnace through the roof 14 and attic 15 into the interior 16 of the building structure. Fixed to the hot air duct is a duty cycling control or means 17. The duty cycling control 17 is mounted to the supply side duct 13 by a generally U-shaped bracket, 18. The bracket includes a top wall 19, a first and a second opposed side walls 21 and 22 which connect a metal base panel 23 to the top wall 19 of the bracket. This provides a bracket which has two opened ends 24 and 25 allowing for air passage through the bracket in opening 24 and out opening 25. The duct 13, includes an opening 26 which is larger than the metal base panel 23 of the bracket 18, but smaller than the top wall 19, of bracket 18. The bracket is fixed to the duct by screwing the overlapping periphery 27 of the top wall 19 to the duct. Preferably a sealent (not shown) is placed between the duct and periphery 27.

The two side walls 21 and 22 include first and second opposed inwardly stepped portions 28 and 29 with ledges 31 and 32. These ledges provide a means to hold a piece of fiberglass insulation 30 on the bracket against the inner side of the top wall 19. (Inner is in reference to the interior of duct 13.) This insulation 30 acts to insulate the duty cycling control 17 from the exterior ambient temperature.

The duty cycling control 17 is simply bolted to the metal base panel 23 of bracket 19. The duty cycling control 17 could be any temperature sensitive switch which closes on rise or on being heated. Preferably it is an adjustable temperature sensitive switch which closes on rise or on being heated. Preferably it is an adjustable temperature sensitive switch which permits adjustment of the switch to a particular unit. The preferred switch is that disclosed in U.S. Pat. No. 4,470,267 the disclosure of which is incorporated herein by reference.

Figure 2:
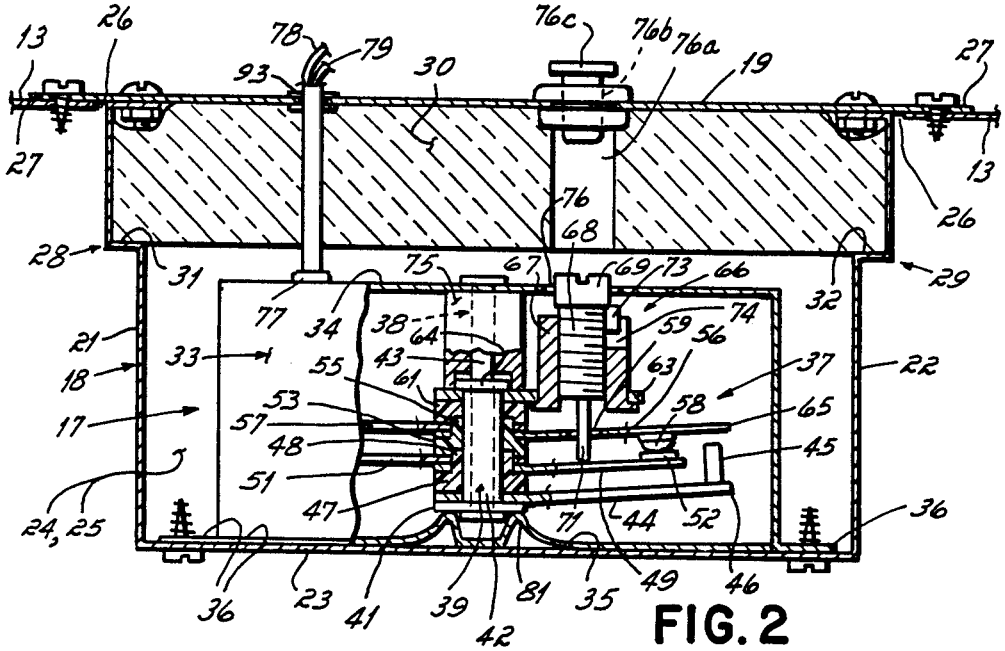
FIG. 2 is a cross sectional view of the duty cycling switch for use in the present invention.

More particularly, referring to FIG. 2, the duty cycling control 17 includes a metal case 33, which has a cupped shaped top cover 34, mounted on a metal base plate 35. Base plate 35 includes a mounting flange 36.

The duty cycling control 17 includes a bi-metallic switch 37, mounted on the top cover by a thermally conductive steel rivet 38. The switch 37, includes a steel holding rivet 39, which has a disc shaped head 41 and a hollow steel stem 42. The internal diameter of the stem 42, is about equal to the external diameter of the stem 43 of steel rivet 38 through the stem 42 of steel holding rivet 39 to hold the switch to the cover as described below.

The switch includes a bi-metal strip 44, mounted on the stem 42 of holding rivet 39 resting against the head 41. A non-conductive porcelan post 45 is fixed to the opposite end 46 of bi-metal strip 44. Non-conductive annular spacer 47 is mounted on stem 42. The spacer 47 includes an upper annular boss 48. Mounted on this annular boss 48 and separated from the metal stem 42 is a first lower contact strip 49 and a lower terminal 51. The contact strip 49 includes a contact or point 52 directed away from the bi-metal strip 44. The terminal 51 and the contact strip 49 are both metallic, electrically conductive and in contact with each other providing an electrical path from terminal 51 to the contact 52. The annular boss 48 extends slightly above the first lower terminal 51.

A second annular non-conductive spacer 53, is mounted on stem 42 and nests on the annular boss 48. The annular boss 48 acts to maintain the terminal 51 and contact strip 49 insulated from metal stem 42. The second non-conductive spacer 53 also includes an annular boss 55. An upper contact strip 56 and a second upper terminal 57 are mounted on this annular boss 55. The second contact strip 56 includes a second contact or point 58 directed toward the first point 52. Contact strip 56 further includes a centrally located aperture 59. Both the second contact strip 56 and the terminal 57 are metallic, electrically conductive and in physical contact with each other providing an electrical path from terminal 57 to the second contact 58.

A third annular non-conductive spacer 61 is supported on the stem 42. Spacer 61 nests on annular boss 55. Thus, the annular boss 55 maintains the terminal 57 and the contact strip 56 insulated from the metallic stem 42.

A tab 63 is also mounted on the stem 42. At the end of stem 42 is an annular rivet head 64 which holds tab 63, spacer 61, terminal 57, contact strip 56, spacer 53, terminal 51, contact strip 49, spacer 47 and bi-metal strip 44 compressed together. The two contact strips 49 and 56 are based towards each other so that the points 52 and 58 are normally in contact providing a complete electrical circuit between terminal 51 and terminal 57. Bi-metal strip 44 is positioned so that upon heating it bends moving posts 45 towards an extended portion 65 of the contact strip 56.

Mounted on tab 63 is an adjusting means or control 66. The adjusting means 66, includes a hollow internally threaded metal sleeve 67, attached to tab 63 and an externally threaded set screw 68 within sleeve 67. The set screw 68 has a slotted head 69 adapted to receive the head of a screw driver. Mounted at the opposite end of the set screw is a non-conducted post 71 which extends through the centrally located aperture 59 in contact strip 56 to a point adjacent to the contact strip 49. Rotation of the set screw in one direction moves the post away from strip 49 allowing strip 49 to bend towards 56. When rotated in the opposite direction it pushes strip 49 away from strip 56 thus changing the distance from post 45 to the extended portion 65 of contact strip 56. This changes the distance the bi-metal strip 44 must move to break the contact between the two points 52 and 58 as well as the temperature at which the bi-metal switch opens and closes. Set screw 68 further includes a radially extended detent 73 and internally threaded sleeve 67 includes a receased stop portion 74. Stop portion 74 lies in the path of the extended detent 73, limiting the degree of rotation of the set screw 68.

The switch is mounted to the cover 34 by steel rivet 38. The rivet passes through the switch 37, spacer 75 and cover 34 and is swagged to hold the switch to the cover through tubular spacer 75 and holds the switch 37 the desired distance from the top of the cover so that the set screw 68 extends slightly above the top cover 34 through aperture 76. This permits adjusting the switch 37 through aligned apertures 76(*a*) and 76(*b*) of plate 19 and insulation 30 without removing the metal housing while the housing and switch are mounted.

Metal housing 33 further includes a rubber grommeted aperture 77 providing a passage for lead 78 and 79 from terminals 51 and 57. Suitable apertures 93 are also provided in insulation 30 and plate 19 for these leads.

The lower metal base 35 of the metal housing includes an annular inwardly raised portion 81 which, in the assembled form contacts the head 41, of the mounting rivet 38 and provides improved thermal conduction through the metal casing into the rivet 39 and bi-metal strip 44. These combine to provide a means to conduct heat from the base to the bi-metal strip whereas air would act as an insulator.

Figure 3:
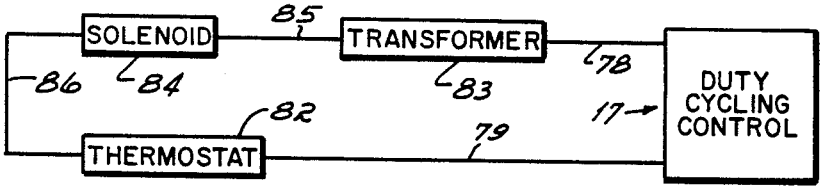
FIG. 3 is a circuit diagram showing the duty cycling switch and thermostat according to the present invention for use with a furnace.

The furnace duty cycling control 17 is wired into the heater solenoid valve circuit (see FIG. 3) in series between the transformer 83 and the thermostat 82. The solenoid 84 is connected directly to a power supply at a first pole (not shown) of transformer 83 by lead 85. A second lead 86 from the solenoid is also connected to the second pole of transformer 83 but the connection is made through the thermostat 82 and the duty cycling control 17. Lead 78 from the terminal 51 connects to the second pole of the transformer 83 and lead 79 from terminal 57 connects to the thermostat 82. Thermostat 82 in turn is connected to the solenoid 84 via lead 86. Thus, the solenoid is activated only when the thermostat and the duty cycling switch are closed (i.e., circuit completed).

The duty cycling control is mounted to the metal base panel 23 of bracket 18 by simply bolting or screwing the mounting flange 36 to the base panel 23. The top wall 19 of bracket 18 includes the aperture 76(*b*) having a removable plug 76(*c*). The aperture is aligned above the set screw 69 and extends through the insulation to provide access to the set screw. Leads 78 and 79 extend through a water tight aperture 93 in top wall 19 and are wired into the solenoid circuit as described above.

To adjust the mounted and wired duty cycling control the thermostat should be turned to a relatively high temperature, i.e., at least about 10 to 15 degrees higher than the room temperature, normally causing the furnace to ignite and burn for an extended period of time, in excess of 5 minutes. The duty cycling switch should be initially closed.

As designed the burning of the heater heats up the fire box and the heat exchangers, which in turn heat up air exiting from the heater. This air is blown through the furnace and exits through duct 13. The air will pass around the duty cycling control 17 and contacts metal base panel 23 of bracket 18. This in turn heats up the base of the duty cycling control and finally the bi-metal strip 44 which bends toward the contact strips. Porcelan knob 45 then contacts the extended portion 65 of the contact strip 58 tending to separate the contacts 52 and 58.

The set screw 68 is rotated to effect a break between the contact points 52 and 58 after a burn period of about 5 minutes (or when the room temprature at the thermostat is 5° to 10° above normal comfort level setting which ever occurs first). After about 5 minutes the heat exchanger should be fully loaded. The adjustment caused by rotation of the set screw 68 alters the distance which extended portion 65 must be moved to separate the contact strips so that approximately at the five minute period, i.e., the time set screw 68 is adjusted, the contact is broken. This eliminates the electrical input into the solenoid 84 causing it to close the fuel valve cutting off fuel to the heater. While this is occurring, the blower, which is independently activated, continues to blow cold air through the furnace drawing heat from the heat exchanger of the furnace. The temperature of the furnace decreases, so does the temperature of the air exiting through duct 13. In turn the temperature of the base panel 23 decreases as well as the base 35 and so does bi-metal strip 44 which backs away from the contact strips and the points 52 and 58 will again contact each other. This closes the circuit and re-initiates the burn, thus creating a cycle.

When the temperature of the area being heated is hot enough to satisfy the thermostat, the thermostat will then break the circuit and discontinue the electrical input to solenoid 84 stopping the burn and stopping the cycle.

A bi-metal switch can be purchased having a desired temperature range. Preferably a slowly responding switch should be used. The temperature at which the duty cycling switch is reclosed is largely dependent on the bi-metal strip. The bi-metal strip, which has an operating temperature of 25° F., adequately functions within the range of a typical furnace.

Preferably the bracket 18 is formed of a heavy gauge metal (20–27 gauge galvinized sheet metal). This acts as a heat sink to which the bi-metal strip is responsive. This in effect slows down the operation of the switch and makes it less sensitive to rapid temperature fluctuations.

Further the cover completely surrounding the duty cycling switch acts to insulate the bi-metal strip from physical contact with the air flowing through the duct. This makes the bi-metal strip more responsive to heat conducted from the metal base panel of bracket 18. Providing the openings 24 and 25 of the bracket in alignment with the air flow through duct 13 permits air to flow around the duty cycling switch permitting a smoother air flow through the bracket.

Figure 4:
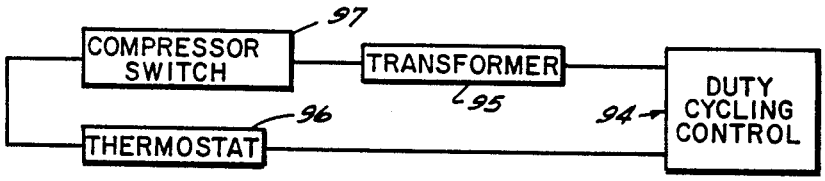
FIG. 4 is a circuit diagram showing the duty cycling switch and thermostat for use in the present invention with an air conditioning unit.

The present invention also operates in the same manner to effectively control an air conditioner. The wiring diagram for the present invention operable to control an air conditioner is shown in FIG. 4. In this embodiment an air conditioner duty cycling control 94 such as that switch shown in FIG. 5 of U.S. Pat. No. 4,470,267 opens in response to a decrease in temperature (i.e., closes on rise). In the embodiment, the duty cycling control 94 is wired in the air conditioning operating circuit between a pole of tranformer 95 and the thermostat 96. The compressor activating switch 97 is then wired between the thermostat 96 and the opposite pole of the transformer 95. The bi-metal switch for the air conditioner is designed to operate between 34° and 150° F., therefore, at room temperature, for example about 70° F. or higher the switch will be closed. Again the particular characteristic of the switch can be changed according to desire. However, these ranges of operation are believed to be the best mode currently known to the inventor.

In all other respects the switch for an air conditioning unit is installed in the same manner described for the furnace. It is also installed in the supply side (cold air) duct 13. A bracket identical to bracket 18 is employed and the duty cycling control is the same as previously disclosed except it closes on rising temperature.

The switch 94, attached to the duct, is adjusted to limit the duration of compressor operation. This is accomplished by turning the adjusting screw as far as possible clockwise to ensure that the switch will be closed. The air conditioner thermostat is then set at its lowest temperature. The air conditioner should be allowed to operate until the temperature at the thermostat is 2 to 4 degrees below the normal setting at the thermostat. The adjusting screw is then turned counter clockwise until the compressor stops. The screw is then turned clockwise about 1° of rotation to set the temperature at which the compressor is deactivated at a slightly warmer temperature. The thermosat should then be reset to its normal or desired temperature.

It has been found that the duty cycling control switch, according to the present invention when internally mounted within a duct, accurately and reliably duty cycles the furnace or air conditioner compressor. This will permit the use of a duty cycling switch attached to the duct of a heating or air conditioning unit where the extreme external ambient temperatures are encountered, such as with roof mounted units. Such a duty cycling control switch is not excessively influenced by rapid fluctuations in air temperature within the duct but accurately functions to activate or deactivate the system to provide for the most efficient utilization of energy.

Thus, having disclosed my invention as well as its advantages and uses I claim:

1. A heating system comprising means to heat air, a duct adapted to transfer air from said means to heat air in an air flow direction;

a duty cycling control adapted to deactivate said means to heat air, said duty cycling control comprising:

an adjustable temperature sensitive switch including a temperature sensitive element operable to open and close said switch;

a case completely enclosing said temperature sensitive switch said case including a metal base;

heat conductive means to transfer heat from said metal base to said temperature sensitive element;

means mounting said entire duty cycling control within said duct;

means to adjust said duty cycling switch when mounted within said duct;

wherein said means mounting said duty cycling control within said duct comprises a bracket fixed to said duct; wherein said bracket includes a metal base panel wherein said metal base of said case is fixed to said panel; and wherein said duct defines an opening adapted to receive said bracket and said bracket includes a top wall adapted to completely cover said opening and at least one said wall extending from said top wall to said metal base panel.

2. The system claimed in claim 1 wherein said top wall is parallel to said metal base panel.

3. The system claimed in claim 1 wherein said bracket includes two opposed open portions aligned with said air flow direction of said duct, thereby permitting air to flow through said bracket.

4. The system claimed in claim 1 wherein said bracket includes insulation between said switch and said top wall.

5. The system claimed in claim 1 wherein said switch comprises a bi-metal switch having two contact means operable in response to a temperature sensitive bi-metal element; said element held in said switch by a metallic rivet, said rivet in physical contact with said metal base, whereby said temperature sensitive bi-metal element is responsive to the temperature of said metal base.

6. A heating system comprising means to heat air, a duct adapted to transfer air from said means to heat air in an air flow direction and said duct defining an opening;

a bracket extending through said opening in said duct said bracket including a top wall completely covering said opening two, side walls extending downwardly from said top wall and connected to a metal base panel;

a temperature sensitive duty cycling means adapted to deactivate said means to heat air, said duty cycling means including:

an adjustable temperature sensitive switch including a bi-metal element and two contacts whereby said bi-metallic element is operable to control the contact of said two contacts;

a case completely enclosing said temperature sensitive switch including a metal base, said switch including a metal rivet in physical contact with said bi-metal element and said base plate, said duty cycling means attached to said bracket with said base plate of said cover fixed to said metal base panel.

7. An air conditioning system comprising means to cool air;

a duct adapted to transfer cool air from said means to cool air in an air flow direction;

a duty cycling means adapted to deactivate said means to cool air said duty cycling means comprising:

an adjustable temperature sensitive switch including a temperature sensitive element operable to open and close said switch;

a case completely enclosing said temperature sensitive switch said case including a metal base;

heat conductive means to transfer heat from said metal base to said temperature sensitive means;

means mounting entire duty cycling means within said duct;

means to adjust said duty cycling switch when mounted within said duct;

wherein said means mounting said duty cycling means within said duct comprises a bracket fixed to said duct; wherein said bracket includes a metal base panel wherein said metal base of said case is fixed to said metal base panel.

8. The system claimed in claim 7 wherein said duct defines an opening adapted to receive said bracket and said bracket includes a top wall adapted to completely cover said opening and at least one side wall extending from said top wall to said metal base panel.

9. The system claimed in claim 8 wherein said top wall is parallel to said metal base panel.

10. The system claimed in claim 8 wherein said switch comprises a bi-metal switch having two contact means operable in response to a temperature sensitive bi-metal element; said element held in said switch by a metallic river, said rivet in physical contact with said metal base, whereby said temperature sensitive bi-metal element is responsive to the temperature of said metal base.

11. The system claimed in claim 7 wherein said bracket includes two opposed open portions aligned with said air flow direction of said duct, thereby permitting air to flow through said bracket.

12. The system claimed in claim 7 wherein said bracket includes insulation between said switch and said top wall.

13. An air conditioning system comprising means to cool air, a duct adapted to transfer air from said means to cool air in an air flow direction and said duct defining an opening;

a bracket extending through said opening in said duct, said bracket including a top wall completely covering said opening, two side walls extending downwardly from said top wall and connected to a metal base panel;

a duty cycling means adapted to deactivate said means to cool air, said duty cycling means including:

an adjustable temperature sensitive switch including a bi-metal element and two contacts whereby both said bi-metal element is operable to control the contact of said two contacts;

case completely enclosing said temperature sensitive switch including a metal base plate, said switch including a metal rivet in physical contact with said bi-metallic element and said base plate;

said duty cycling means attached to said bracket with said base plate of said cover fixed to said metal base panel.

* * * * *